United States Patent [19]

Schneider

[11] Patent Number: 4,480,763

[45] Date of Patent: Nov. 6, 1984

[54] BEVERAGE CONTAINER OPENING MEANS

[76] Inventor: Fritz N. Schneider, 22030 Madison St., Dearborn, Mich. 48124

[21] Appl. No.: 431,820

[22] Filed: Sep. 30, 1982

[51] Int. Cl.[3] ..... B65D 17/34

[52] U.S. Cl. ..... 220/269

[58] Field of Search ..... 220/269–273; 222/478

[56] References Cited

U.S. PATENT DOCUMENTS

| | | | |
|---|---|---|---|
| 4,211,335 | 7/1980 | Langseder | 220/269 |
| 4,247,014 | 1/1981 | Walz | 220/269 |
| 4,266,688 | 5/1981 | Reid | 220/269 |

*Primary Examiner*—George T. Hall

*Attorney, Agent, or Firm*—Gifford, VanOphem, Sheridan, Sprinkle & Nabozny

[57] ABSTRACT

A beverage container or can comprising a main body having a top and defining an interior chamber in which the beverage is contained. The top wall includes a portion surrounded by a score while a tab is secured to the can top. One end of the tab registers with the scored portion while the other end of the tab extends outwardly from the scored portion. The other end of the tab is also spaced upwardly from the can top so that the tab can be easily grasped and pulled outwardly from the can whereupon the first end of the tab engages the scored portion and punches the scored portion into the interior of the can. In the preferred form of the invention, the scored portion is formed on an upwardly inclined portion of the can top which forms a spout.

9 Claims, 10 Drawing Figures

BEVERAGE CONTAINER OPENING MEANS

BACKGROUND OF THE INVENTION

I. Field of the Invention

The present invention relates generally to beverage containers and, more particularly, to such a container with an improved opening tab and drinking spout.

II. Description of the Prior Art

There are a number of previously known beverage containers or cans which contain beer, pop and the like. Many of the previously known containers can be manually opened and their contents consumed.

In one type of previously known can, the opening tab is detachable from the top wall of the can and, upon detachment, creates an opening in the top of the can. These tabs, however, were often simply discarded on the ground. Since the tab contains sharp edges, these discarded tabs created a safety hazard to pedestrians, animals and the like.

In a still further type of previously known cans, a scored portion is formed on the top of the can. An opening tab is also secured to the can top so that one end of the tab is positioned over the scored portion. The other end of the tab is lifted outwardly from the can thus bending the tab and simultaneously punching the scored portion into the interior of the can and forming an opening. These previously known opening tabs, however, have not proven entirely satisfactory in use.

One disadvantage of these previously known tabs is that the tab is fastened flat against the top of the can and it is very difficult to grasp the tab in order to pull it outwardly to open the can. Oftentimes, the user breaks his or her fingernails while trying to pry the tab away from the top of the can.

A still further disadvantage of these previously known opening tabs is that they are of relatively flimsy construction and this is particularly true for the portion of the tab which bends when the tab is pulled outwardly from the can. Frequently, the tab separates or breaks away from the top of the can along its bendable portion. Once this happens, a separate can opener must be located and used to open the cans.

A still further disadvantage of these previously known beverage cans is that a rim extends upwardly from and around the top of the can. This rim interferes with the normal flow of the beverage from the can opening and oftentimes causes spilling the beverage on the person and his or her clothes while drinking from the can.

SUMMARY OF THE PRESENT INVENTION

The present invention provides an improved beverage can which overcomes the above mentioned disadvantages of the previously known cans.

In brief, the beverage can of the present invention comprises a main body having a top and defining an interior chamber in which the beverage is contained. The top of the can includes a portion surrounded by a score which, when punched into the interior of the can, forms an opening in the top of the can.

A tab is secured at a midpoint to the top of the can so that one end of the tab registers with the scored portion. The other or second end of the tab extends outwardly from the scored portion so that, when the other end of the tab is lifted upwardly from the top of the can, the first end of the tab engages the scored portion and punches it into the interior of the can.

The second end of the tab is spaced upwardly from the top of the can by a distance sufficient to allow at least a portion of a normal finger to be positioned between the tab and the top wall. This spacing thus allows the second end of the tab to be easily grasped by the user.

In the preferred form of the invention, the top of the can includes an inclined surface which slopes upwardly from the center of the can and towards the rim so that the outer edge of the inclined surface is adjacent and substantially flush with the top of the rim. The scored portion is formed on this inclined surface so that the inclined surface forms a spout for the beverage as it is consumed. A contoured surface which conforms to a human lip is preferably formed around the outer edge of the inclined surface so that the can rim does not interfere with the normal flow of the beverage as it is consumed.

BRIEF DESCRIPTION OF THE DRAWING

A better understanding of the present invention will be had upon reference to the following detailed description, when read in conjunction with the accompanying drawing wherein like reference characters refer to like parts throughout the several views, and in which.

DETAILED DESCRIPTION OF A PREFERRED EMBODIMENT OF THE PRESENT INVENTION

Figure 1:
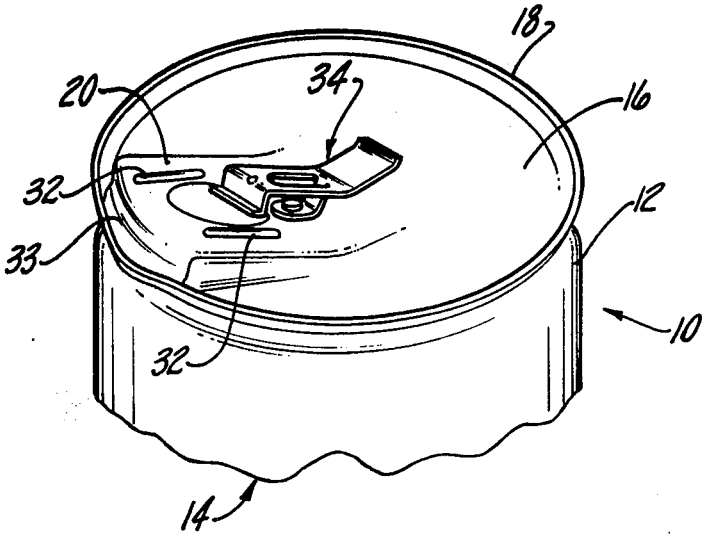
FIG. 1 is a fragmentary elevational view illustrating a first preferred embodiment of the present invention.
Figure 2:
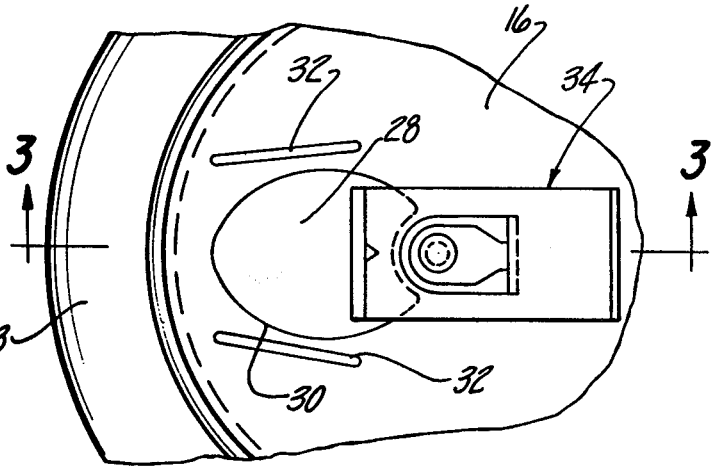
FIG. 2 is a fragmentary top plan view thereof and enlarged for clarity.

With reference first to FIGS. 1 and 2, a beverage container or can 10 is thereshown comprising a main body 12 defining an interior chamber 14 in which the beverage is contained. A circular top 16 closes the upper end of the main body 12 of the can 10. A rim 18 is formed at the junction of the can main body 12 with its top 16 and, as best shown in FIG. 3, this rim 18 protrudes upwardly from the can top 16.

Figure 3:
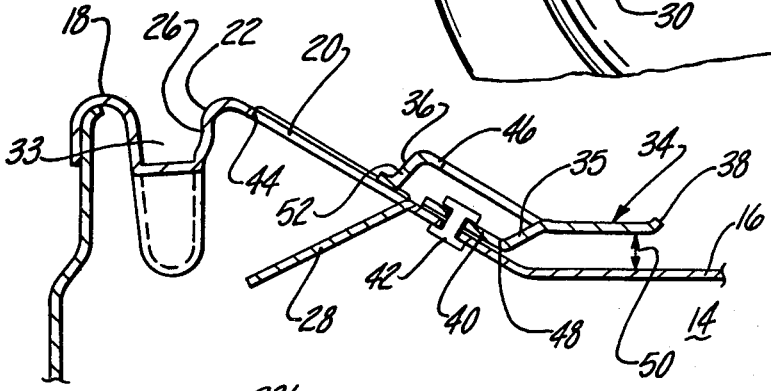
FIG. 3 is a cross sectional view taken substantially along line 3—3 in FIG. 2.

Still referring to FIGS. 1–3, the top 16 of the can 12 includes a slope or inclined portion 20 which slopes upwardly from approximately the center of the top 16 and upwardly towards the rim 18. The inclined surface 20 includes an outer arcuate edge 22 which is positioned adjacent and substantially flush with the top of the rim 18. In addition, this outer edge 22 of the inclined surface 20 includes a contoured surface 26 which conforms to the lip of a person for a reason to be shortly described.

A generally circular or oval portion 28 of the inclined surface 20 is surrounded by a score 30 as best shown in FIG. 2. In addition, a generally radially extending raised ridge 32 is provided on each side of the scored portion 28 for a purpose to be subsequently described. A local channel 33 (FIGS. 1 and 3) is also preferably formed adjacent the rim 18 to guide or channel the flow of liquid from the can 12.

Still referring to FIGS. 1–3, an opening tab 34 has a first end 36 which registers with the scored portion 28 while the other end 38 of the tab 34 extends outwardly from the scored portion 28. A midpoint 40 of the tab 34 is secured to the can top wall 16 by any conventional means, such as a rivet 42. A portion 35 of the tab 34 is sufficiently bendable so that the end 38 of the tab, when pulled outwardly from the can top 16, forces the first end 36 of the tab 34 against the scored portion 28 and punches the scored portion 28 into the interior 14 of the can 10 (FIG. 3). Upon doing so, an opening 44 defined by the score 30 is formed in the inclined surface 20 of the can top 16 and from which the beverage is dispensed.

With reference now particularly to FIG. 3, the tab 34 preferably comprises spaced apart and substantially parallel portions 46 and 48. The portion 48, which is preferably stamped from the portion 46, is secured to the can by the rivet 42 and the end 38 of the tab 34 extends outwardly from the upper tab portion 46. Consequently, the tab end 38 is spaced upwardly from the can top 16 by the distance 50 which is sufficient to allow at least a portion of a human finger between the can top 16 and the tab end 38. Since the tab end 38 is spaced outwardly from the can top 16, the tab end 38 can be easily grasped and pulled outwardly to open the can. In addition, the opposite or first end 36 of the tab includes a portion 52 which extends generally perpendicularly towards and abuts against the scored portion 28 of the can top 16 to enhance the leverage of the tab 34 when used to open the can.

Figure 6:
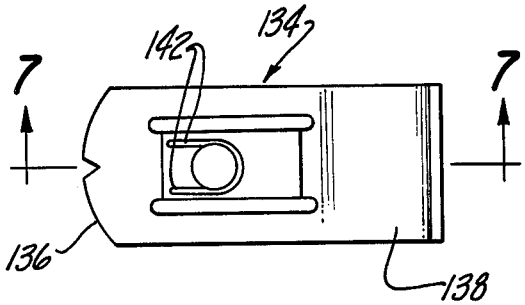
FIG. 6 is a top plan view illustrating a still further preferred embodiment of the present invention.
Figure 7:
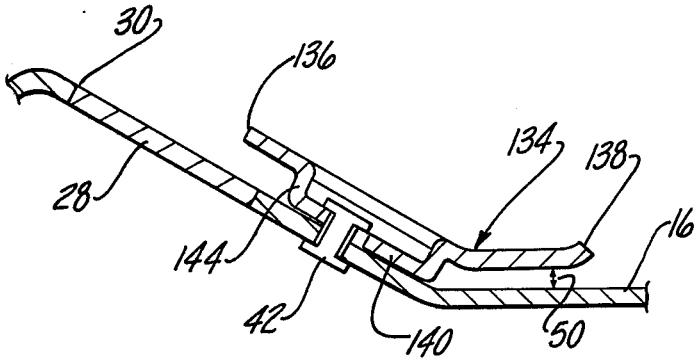
FIG. 7 is a cross sectional view taken substantially along 7—7 in FIG. 6.
Figure 8:
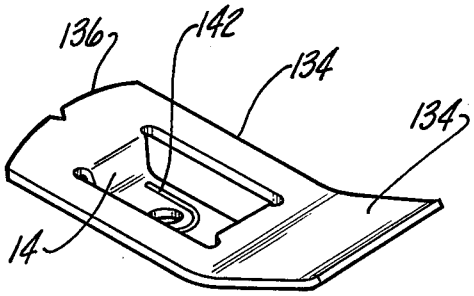
FIG. 8 is an elevational view of the embodiment of the invention shown in FIGS. 6 and 7.

With reference now to FIGS. 6–8, a further preferred embodiment of the invention is thereshown which utilizes a different construction for the opening tab. The opening tab 134 includes a first end 136 which registers with the scored portion 28 of the can top 16. Similarly, the other end 138 extends outwardly from the scored portion 28 and is spaced upwardly from the can top 16 by the distance 50. Consequently, when the end 138 of the tab 134 is pulled outwardly from the can top 16, the first tab end 136 abuts against the scored portion 28 and punches the scored portion 28 into the interior 14 of the can to open it.

Unlike the tab shown in FIGS. 1–3, however, the tab 134 includes a U-shaped central portion 140 which is secured to the can top 16 by the rivet 42. Bending slots 142 are interconnected around the rivet 42 and extend toward the first tab end 136 so that, when the tab 138 is pulled outwardly from the can top 16, the tab 134 bends around a perpendicularly extending wall 134 between the rivet 42 and the scored portion 28.

Figure 9:
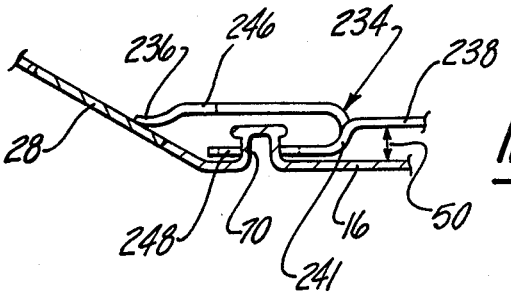
FIG. 9 is a cross sectional view illustrating yet a further preferred embodiment of the present invention.
Figure 10:
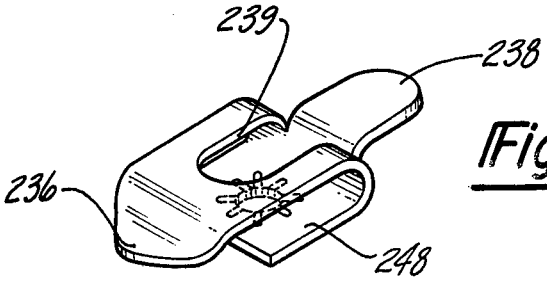
FIG. 10 is an elevational view of the embodiment of the invention shown in FIG. 9.

With reference now to FIGS. 9 and 10, a still further preferred embodiment of the present invention is thereshown in which a tab 234 includes a pointed first end 236 which abuts against the scored portion 28. As before, the other end 238 of the tab 234 protrudes outwardly from the scored portion 28 and is spaced upwardly from the can top 16 by the distance 50. The tab 234 differs from the tabs 34 and 134 in that the end 238 of the tab 234 is punched from an opening 239 formed in the upper portion 246 of the tab 234. The lower portion 248 is secured to the can top 16 by a rivet 70 so that, when the tab end 238 is pulled outwardly from the can top 16, the tab 234 bends around a perpendicularly extending portion 241 of the tab 234 between the rivet 70 and the tab end 238.

Figure 4:
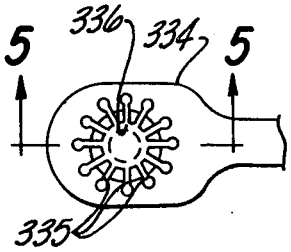
FIG. 4 is a top plan view illustrating a second preferred embodiment of the present invention.
Figure 5:
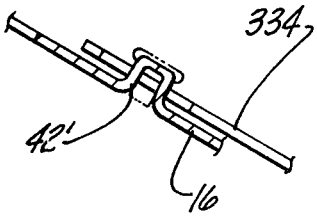
FIG. 5 is a sectional view taken substantially along line 5—5 in FIG. 4.

With reference now to FIGS. 4 and 5, a tab 334 is thereshown having a plurality of radial serrations 335. Unlike the tabs 34 and 134, however, the tab 334 is secured to the can top 16 by a rivet 42' (FIG. 5) which is formed from the can top 16. The rivet 42' extends through a hole 336 in the tab 334 to the position shown in FIG. 5. Once the rivet 42' is positioned to the tab 334, the rivet 42' is bent over, as shown in phantom line (FIG. 5) thus sandwiching a portion of the tab 334 around the serrations 335 in between the rivet 42' and the can top 16. The serrations 335 enable the tab 334 to easily bend when used to open the can.

With reference now to FIGS. 1–3, the operation of the can will now be described. As previously described, the end 38 of the tab 34 is pulled outwardly away from the can top 16 whereupon the tab end 36 punches the scored portion 28 into the interior of the can. The beverage may then be drunk from the can by the person placing his lower lip against the contoured portion 26 and tipping the can towards his mouth. As the beverage pours outwardly through the opening 44, the ridges 32 channel the beverage towards the mouth and minimizes splashing of the beverage.

The primary advantage of the beverage can of the present invention is that the pull tab can be easily grasped and opened by the user. Moreover, the heavy duty construction of the pull tab minimizes breakage or separation of the tab from the can as has been known to the prior beverage cans. The tab also preferably comprises a one-piece stamping thus minimizing manufacturing costs.

A still further advantage of the present invention comprises the inclined surface 20 which forms a pouring spout for the beverage. If desired, the outer rim 18 of the can adjacent the outer edge of the inclined surface 20 can be contoured downwardly to provide a more open access to the spout for the user.

Having described my invention, however, many modifications thereto will become apparent to those skilled in the art to which it pertains without deviation from the spirit of the invention as defined by the scope of the appended claims.

I claim:

1. A beverage container comprising:

a main body having a top, said main body defining an interior chamber in which a beverage is contained, said top having a portion surrounded by a score;

a tab;

means for securing a midpoint of said tab to said top wall so that one end of said tab registers with said scored portion while the other end of said tab extends outwardly from said scored portion, said other end of said tab being spaced from the top wall by a distance sufficient to allow at least a portion of a finger of a normal adult to be positioned between said other end of said tab and said top;

whereby said other end of said tab is easily grasped and pulled outwardly from said top wall whereupon said one end of said tab punches said scored portion into the interior of said can; and wherein said main body comprises an outwardly extending rim formed around the outer periphery of said top wall, said top comprising an inclined surface which slopes upwardly from a midpoint of said top and towards said rim, an outer end of said inclined section terminating closely adjacent said rim and wherein said scored portion is formed on said inclined surface.

2. The invention as defined in claim 1 and comprising a pair of spaced raised ridges formed on said inclined section so that one ridge is formed on each side of said scored portion.

3. The invention as defined in claim 1 and comprising a contoured surface on the outer end of said inclined surface which conforms to a human lip.

4. The invention as defined in claim 1 wherein said tab comprises spaced apart and substantially parallel portions and wherein said securing means attaches one of said tab portions to said top.

5. The invention as defined in claim 4 wherein said tab comprises a one piece stamping.

6. The invention as defined in claim 1 wherein said securing means comprises a rivet.

7. The invention as defined in claim 4 wherein said one end of said tab comprises a part which extends from said other tab portion and toward said top.

8. The invention as defined in claim 1 wherein said tab includes an aperture and wherein said securing means comprises a raised portion of said top which extends through said tab aperture, said raised portion being flattened against said tab so that a part of said flattened raised portion overlaps said tab.

9. A beverage container comprising:

a main body having a top, said main body defining an interior chamber in which a beverage is contained, said top having a portion surrounded by a score, a tab, means for securing a midpoint of said tab to said top wall so that one end of said tab registers with said scored portion while the other end of said tab extends outwardly from said scored portion, and wherein said main body comprises an outwardly extending rim formed around the outer periphery of said top wall, said top comprising an inclined surface which slopes upwardly from a midpoint of said top and towards said rim, an outer end of said inclined section terminating closely adjacent said rim and wherein said scored portion is formed on said inclined surface.

* * * * *

UNITED STATES PATENT AND TRADEMARK OFFICE

CERTIFICATE OF CORRECTION

PATENT NO. : 4,480,763

DATED : November 6, 1984

INVENTOR(S) : Fritz N. Schneider

It is certified that error appears in the above-identified patent and that said Letters Patent is hereby corrected as shown below:

Column 2, line 41 after "along" insert--line--.

Signed and Sealed this

*Sixteenth* Day of *July 1985*

[SEAL]

*Attest:*

DONALD J. QUIGG

*Attesting Officer* *Acting Commissioner of Patents and Trademarks*